United States Patent [19]

Sheehan et al.

[11] Patent Number: 4,786,105

[45] Date of Patent: Nov. 22, 1988

[54] CONTINUALLY POSITIONABLE CHAIR WITH ADJUSTABLE LUMBAR SUPPORT

[75] Inventors: Kelly J. Sheehan, Minnetonka; Dennis A. Woggon, Rice, both of Minn.

[73] Assignee: All Day Chair Company, St. Cloud, Minn.

[21] Appl. No.: 159,700

[22] Filed: Feb. 24, 1988

[51] Int. Cl.[4] ..... A47C 7/02

[52] U.S. Cl. ..... 297/258; 297/294; 297/383

[58] Field of Search ..... 297/258, 299, 295, 296, 297/270, 239, 345, 451

[56] References Cited

U.S. PATENT DOCUMENTS

| | | | |
|---|---|---|---|
| D. 141,551 | 6/1945 | Edelson | 297/258 X |
| 1,301,639 | 4/1919 | Barker | 297/258 |
| 1,941,340 | 12/1933 | Dellert | 297/239 |
| 1,976,326 | 10/1934 | Carlton | 297/383 |
| 2,141,475 | 12/1938 | Johannsen | 297/295 X |
| 2,713,386 | 7/1955 | Holtz | 297/294 X |
| 2,722,967 | 11/1955 | Reinholz . | |
| 3,099,477 | 7/1963 | O'Herron | 297/258 X |
| 3,356,412 | 12/1967 | Grondstra | 297/258 |
| 3,556,591 | 1/1971 | Smith . | |
| 3,880,463 | 4/1975 | Shephard et al. . | |
| 3,989,297 | 11/1976 | Kerstholt . | |
| 4,170,382 | 10/1979 | Wheeler . | |
| 4,222,607 | 9/1980 | Dimmock . | |
| 4,383,714 | 5/1983 | Ishida . | |
| 4,451,085 | 5/1984 | Franck et al. . | |
| 4,489,982 | 12/1984 | Morrow . | |
| 4,500,137 | 2/1985 | Morehouse . | |
| 4,509,793 | 4/1985 | Wiesmann et al. . | |
| 4,534,591 | 8/1985 | Parker . | |
| 4,552,404 | 11/1985 | Congleton . | |
| 4,595,234 | 6/1986 | Kjersem . | |
| 4,597,386 | 7/1986 | Goldstein . | |
| 4,634,178 | 1/1987 | Carney . | |
| 4,640,547 | 2/1987 | Fromme . | |
| 4,640,548 | 2/1987 | Desanta . | |
| 4,682,814 | 7/1987 | Hansen . | |
| 4,682,815 | 7/1987 | Steinfensand . | |
| 4,690,459 | 9/1987 | Ullman . | |

*Primary Examiner*—Peter A. Aschenbrenner
*Attorney, Agent, or Firm*—Kinney & Lange

[57] ABSTRACT

The present invention provides a chair with a seat cushion thickened toward the front thereof, and thinned toward the rear, positioned on a support frame having a pair of legs extending down to a pair of curved rails which flair apart from one another toward the rear thereof. These rails extend forward sufficiently that the chair can be tilted forward along the rails on a horizontal surface until the top of the seat cushion slopes downward, and these rails extend rearward sufficiently such that the chair can be tilted rearward therealong until the seat cushion top again slopes downward. The backrest extending from underneath the cushion, and then upward therefrom, carries a cushion which is thickened toward the top thereof and thinned toward the bottom. This cushion is adjustably positionable up or down along the backrest to be available to be positioned against a user's lumbar region depending on the length of the user's back. The backrest may also be adjustable suitable forward and backward to fit the length of the user's legs between the pelvis and the back of the knees.

7 Claims, 1 Drawing Sheet

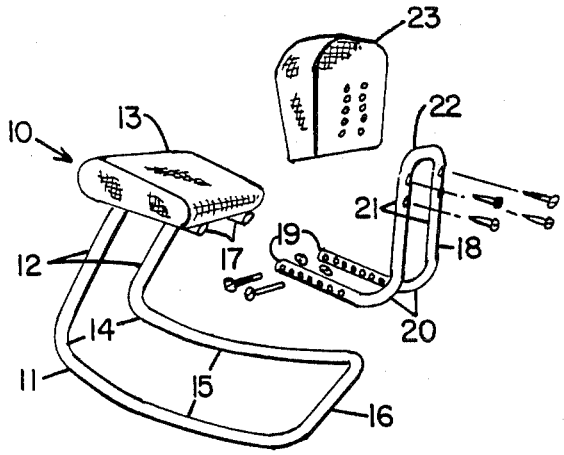
Fig 1
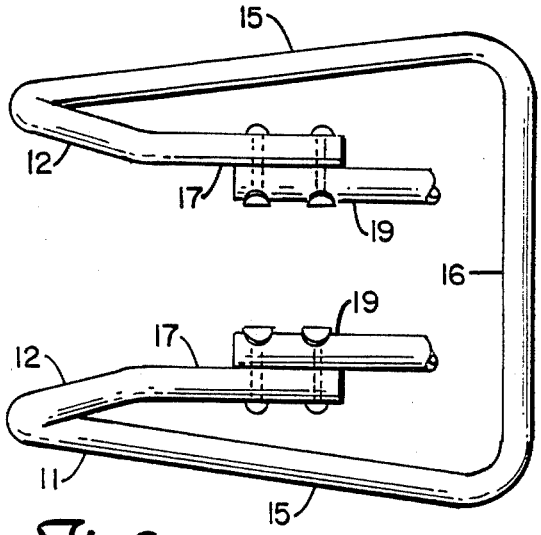
Fig 3
Fig 2
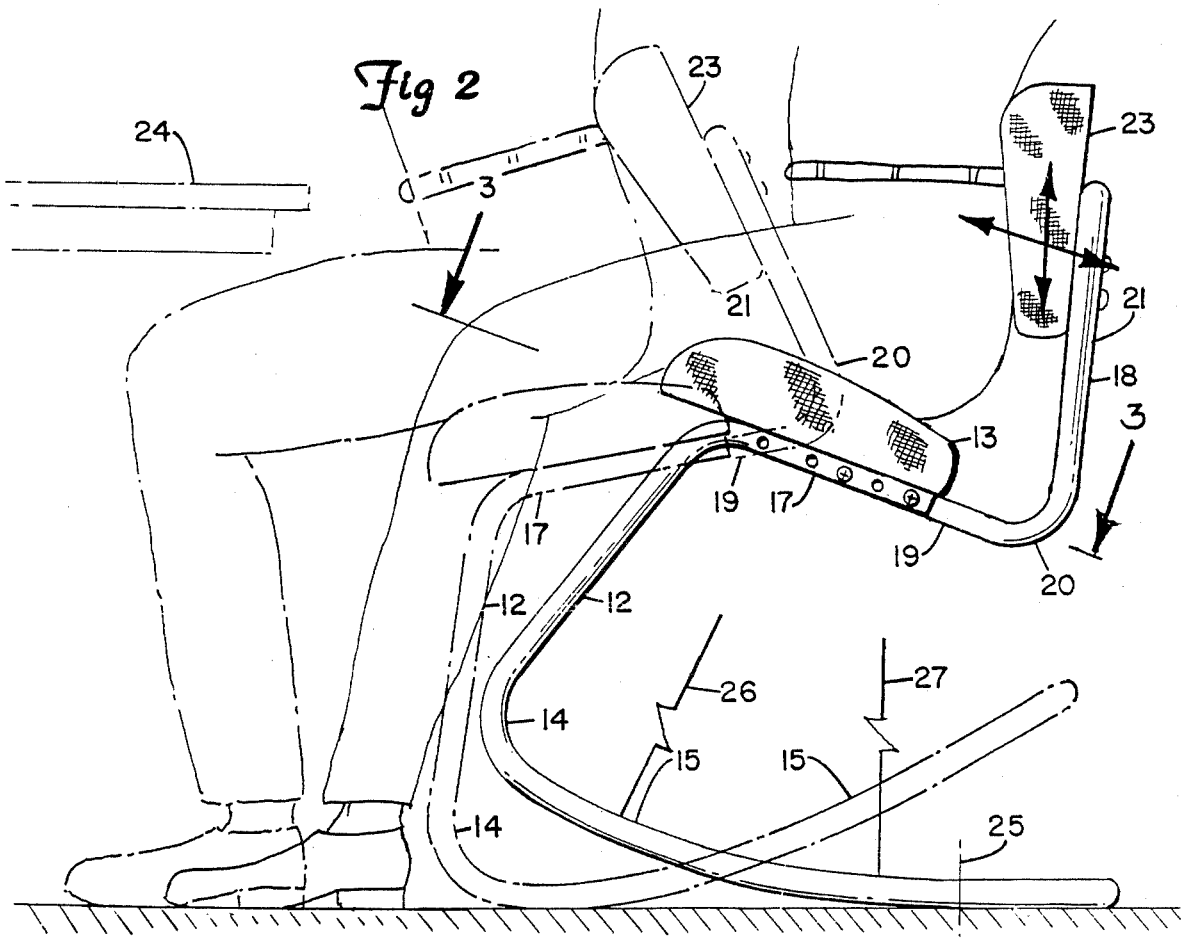

CONTINUALLY POSITIONABLE CHAIR WITH ADJUSTABLE LUMBAR SUPPORT

BACKGROUND OF THE INVENTION

The present invention relates to chairs which can be placed by the user in either task accomplishing positions or rest positions and, more particularly, to such positionable chairs which also position the spine and pelvic region of the user to reduce efforts required of associated muscles.

The posture taken by an individual while seated often determines the amount of strain occurring in the muscles associated with the spine and pelvis, and the fatigue that results. The posture may be poor, either because the chair in use forces the spine into unnatural positions or because the user slouches while sitting.

Typical chair backrest cushions often have a bulge on the user's side of thereof which is located at a relatively low position therealong with respect to the back, often just above the pelvic area. Such cushion bulges block the movement of the supraspinous ligament and several of the vertebral segments. Rearward movement of these segments is necessary for achieving proper equilibrium in the spine of one sitting on a chair in an upright position in accomplishing tasks in front of them. Because such spinal movement is blocked, the center of gravity of the body is kept too far forward leading to a moment about the ischium of the seated pelvis which must be compensated for by various spinal muscles continually contracting.

On the other hand, many chairs do not permit the user to also recline somewhat with the spine tilted significantly backward for purposes of resting, a decided help since rearward inclination of the back on an inclined backrest permits the backrest to support up to half the weight of the upper torso. An inability to incline backwards to permit the chair backrest to take up some of the upper torso weight leaves only the back muscles to continually support such weight.

In doing tasks in an upright sitting position, a user of a chair will have a desire to be tilted relatively forward of, or backward from, some usual task-accomplishing position, and at varying angles. The desired changes from this usual upright position will depend on the particular portion of the task being undertaken. Also, the usual position taken for accomplishing tasks will depend on the task, the length of the person's legs and arms, etc. The ability of the user to adjust his upright position continually at his or her desire to a selected degree will be less tiring for that person if such adjustments can be made while minimizing any efforts which involve having to shift position with respect to the chair, or involve having to move the chair along the horizontal surface on which it rests.

Thus, there is desired a chair which fully supports the natural lumbar lordotic curve of the lower spine of a user in most upright positions and in any reclining positions, the chair being able to permit the user to conveniently attain all such positions. Further, the chair should be able to change between various upright positions easily, and to change between upright positions and reclining positions easily.

SUMMARY OF THE INVENTION

The present invention provides a chair with a seat cushion thickened toward the front thereof, and thinned toward the rear, positioned on a support frame having a pair of legs extending down to a pair of curved rails which flair apart from one another toward the rear thereof. These rails extend forward sufficiently that the chair can be tilted forward along the rails on a horizontal surface until the top of the seat cushion slopes downward, and these rails extend rearward sufficiently such that the chair can be tilted rearward therealong until the seat cushion top again slopes downward. The backrest extending from underneath the cushion, and then upward therefrom, carries a cushion which is thickened toward the top thereof and thinned toward the bottom. This cushion is adjustably positionable up or down along the backrest to be available to be positioned against a user's lumbar region depending on the length of the user's back. The backrest may also be adjustable forward and backward to fit the length length of the user's legs between the pelvis and the back of the knees.

The support frame may be formed of a single tube with the rails having been formed by compound curves. The curvature toward the front of the rails is sharper to permit easy rocking forward, but is less curved toward the rear to permit a slower backward tilt into a reclining position.

BRIEF DESCRIPTION OF THE DRAWINGS

FIG. 1 shows a partially exploded view of the present invention,

FIG. 2 shows the chair with a user in two possible positions, and

FIG. 3 shows a cross section view of a portion of the present invention.

DETAILED DESCRIPTION OF THE PREFERRED EMBODIMENTS

FIG. 1 shows a partially exploded view of that chair, 10, forming the present invention. A continuous tubular frame, 11, is shown formed by a single tube which has been bent to the shape shown. Tubular frame 11 has a pair of chair support legs, 12, affixed to the bottom of a seat cushion, 13. Legs 12 extend downward at about 60°, and so somewhat forward, from seat cushion 13 to where the tube from which they are formed is sharply bent at a pair of corresponding bends, 14. Leaving bends 14, the remaining portions of tubular frame 11 serve as a pair of corresponding curved rails, 15, joined by a rear cross-connecting portion, 16. Legs 12 are affixed to the bottom of seat cushion 13 by a portion of each end of the tube forming frame 11 which are a relatively sharply bent over from support legs 12 to form a pair of seat cushion supports, 17.

Cushion supports 17 have holes therethrough parallel to the horizontal surface on which chair 10 rests which match holes in a backrest tubular frame, 18, formed by another single tube bent to the shape shown, these matching holes being located in fastening portions, 19, thereof. Fastening portions 19 are formed in this tube by its two end portions formed parallel to one another. By positioning fastening portions 19 of tubular frame 18 either relatively back or forward parallel to portions 17 of tubular frame 11, tubular frame 18 may be fastened either closer to or further away from the rear facing end of seat cushion 13. This allows a user of chair 10 to adjust the backrest of which tubular frame 18 is a part to get it closer to or further from seat cushion 13. This adjustment capability permits accommodating differing lengths of the legs of different users between the pelvis and the back of the knees.

Tubular backrest frame 18 has a corresponding pair of relatively sharp bends, 20, leading upward from fastening portions 19 so that the remainder thereof forms a pair of backrest cushion mounting portions, 21, which are joined together again by a top, cross-connecting piece 22. Through holes provided in backrest cushion mounting portions 21, fasteners can be inserted into the back of a backrest cushion, 23, in any of the holes in the pair of corresponding vertical sequence sets of holes provided therein. Thus, cushion 23 can be adjusted up and down with respect to backrest cushion mounting portions 21, and so with respect to the upper, or seating, surface of seat cushion 13. This adjustment capability permits selecting a position for backrest cushion 23 with respect to seat cushion 13 for the dimensions of a particular user so that backrest cushion 23 can be placed to support the lumbar region of the user, and so reinforce the natural lordotic curve of that user's back.

FIG. 2 shows a user in the chair having moved chair 10 into two of the alternative positions possible with this chair, a forward, task accomplishing position shown in dashed lines and a rearward, rest position shown in solid lines. An indication of a cross section view of the rearward position is provided in FIG. 2, this view being provided in FIG. 3. As can be seen in FIG. 3, rails 15 flare outward from one another toward the rear, reaching the greatest separation from one another where each is joined by cross-connecting portion 16. This outward flaring provides increased side-to-side stability so that a user reclining rearward can do so confidently without anxiety as to the resulting reduced control of the user's stability in that position. Such a reduction in stability control results because the user's legs are no longer positioned, if the user is tilted rearward, to be as capable of permitting the user to recover by placing a foot on the supporting floor to retain balance should any turning, twisting or leaning upset the user's stability.

The fasteners shown in FIGS. 1 and 3 joining seat cushion supports 17 of frame 11 with fastening portions 19 of frame 18 are threaded bolts which fit into threaded nuts each having a flange thereon adapted to the curvature of fastening portions 19. The fasteners shown in FIG. 1 used for fastening backrest cushion 23 to backrest cushion mounting portions 21 are typically threaded bolts fitting into threaded inserts embedded in the back of cushion 23.

Returning to FIG. 2, the arrows shown there superimposed on backrest cushion 23 in the rearward position view show the directions that this cushion can be effectively adjusted to accommodate the physical dimensions of the user of chair 10. The arrows shown pointing upward to the left and downward to the right are the direction of adjustment available by shifting fastening portions 19 with respect to seat cushion supports 17. The arrows pointing opposite ways along the vertical show the directions backrest cushion 23 can be adjusted with respect to backrest cushion mounting portions 21.

In the forward position in FIG. 2, shown in dashed lines as noted above, the user has positioned the chair forward along rails 15 and, in doing so, has moved his body closer to the work surface arrangement, 24, shown in the figure. Rails 15 are formed with the tube portions of frame 11 used therefor each being bent to follow a compound curve with a shorter radius of curvature, or a sharper curvature, present in the forward portion of rails 15. This allows the user to move chair 10 in forward positions relatively rapidly and easily either forward or backward along rails 15 to thereby shift the user's body closer or further from work surface 24. That is, the user can find a comfortable, usual position for the task at hand somewhere along the forward portion of rails 15, but can make sensitive position adjustments thereabout for any portions of the task requiring somewhat different positioning both quickly and easily merely by straightening or bending the user's legs. Rails 15 extend forward sufficiently before encountering bends 14 so that the bottom surface of seat cushion 13 can be inclined downward to the left by about 10° with respect to the horizontal surface on which chair 10 rests.

On the other hand, in the rearward position shown in solid lines, the user has tilted his upper torso and chair 10 backward so that rails 15 move from contacting the horizontal surface on which chair 10 rests near forward portions thereof to contacting this surface at more rearward positions. Some distance toward the rear from legs 12, i.e. past the forward portions of rails 15, these rails are formed following the compound curve having an increased radius of curvature, i.e. the curvature is reduced, so that the ease and rate of tilting backward is decreased. This contributes to the user's feeling of stability in moving backward by slowing his rate of rearward movement for a given leg force.

Finally, the contact points of rails 15 reach a portion therealong which has no curvature at all to thereby stop rearward motion at a stable location. This portion occurs to the right of a vertical dashed line, 25, shown in the rearward position view of FIG. 2. In this position, the bottom surface of seat cushion 13 is inclined downward to the right at about 20° with respect to the horizontal surface on which chair 10 rests. The mounting, or rear, surface of backrest cushion 23 in this position has a clockwise angle from this surface of approximately 120°

Indications of the relative radii of curvature for the two portions of rails 15 toward the front of chair 10 from vertical dashed line 25 are also shown, a shorter radius, 26, being indicated at the furthest forward position of rails 15. A longer radius of curvature, 27, is indicated along rails 15 at the portions thereof immediately forward of vertical dashed line 25.

Seat cushion 13 is shown thickened toward the end thereof facing forward compared to the relatively thin structure it has toward the end thereof facing rearward. Thus, the user in a forward position, such as the one shown in dashed lines in FIG. 2, is supported on a thickened portion of cushion 13 providing a structure which keeps the user from sliding forward on cushion 13, and so reduces the user's risk of falling off chair 10 in that position. Cushion 23 has a top edge thereof still in contact with the user's back to provide some support, and to prevent slouching, in this forward, task-accomplishing position.

In the rearward position shown in solid lines in FIG. 2, the thickened upper portion of cushion 23 near the upward facing end, properly positioned, is firmly in contact with the lumbar region of the user's back. The thinner bottom portion of cushion 23 near its downward facing end, along with the thinner rear portion of cushion 13, allows room for the pelvis of the user to rotate slightly in a clockwise direction while the thicker upper portion of cushion 23 continues to support the lumbar region of the user. This slight rotation of the pelvis places the center of gravity of the user's upper torso over the ischium and thereby relieves the associated muscles of having to overcome any moments about the ischium leading to fatigue as the spine now follows the natural lordotic curve. This positioning of the spine is assured by having the angle between the straight portions of seat cushion supports 19 and backrest cushion supports 21 being approximately 75°, and with having the user-contacting surfaces of each of cushions 13 and 23 being inclined at approximate 7.5° to the back surfaces of these cushions where supported by the tubular frames 11 and 18, respectively. This combination of angles leaves approximately a 60° angle between the user-contacting surfaces of cushions 13 and 23 as is desired for supporting the natural lordotic curve of the user's back.

Although the present invention has been described with reference to preferred embodiments, workers skilled in the art will recognize that changes may be made in form and detail without departing from the spirit and scope of the invention.

What is claimed is:

1. A continually positionable chair, positionable between a rear rest position and selected forward positions suited to a user's task, and with a backrest providing support to a user's lumbar region if said chair is positioned near said rear rest position, said chair comprising:

a seat cushion having a base surface separated from a seating surface by a greater amount at locations toward its front facing end than at locations near its rear facing end;

a support frame, attached to said seat cushion base surface, having a pair of legs extending away from said seat cushion base surface and supported by a pair of non-parallel, curved rails spaced further apart from one another toward rear portions thereof than they are toward front portions thereof, said rails extending forward sufficiently such that said chair can be tilted forward therealong on a horizontal surface until said seat cushion base surface slopes downward, and extending rearward sufficiently that said chair can be tilted rearward therealong until said seat cushion base surface again slopes downward; and a backrest having a backrest frame extending from said seat cushion base surface to curve upward, and having a backrest cushion with a back surface separated from a support surface thereof by a greater amount at locations near its upward facing end surface than at locations near its downward facing end surface, said backrest cushion being adjustably attached to said backrest frame such that said backrest cushion can be adjusted upwardly and downwardly along said backrest frame within a selected range so that it may be positioned to support a user's lumbar region.

2. The apparatus of claim 1 wherein said backrest frame is adjustably attached at said seat cushion base surface such that it can be moved therealong forwardly and rearwardly within a selected range to accommodate that length occurring between a user's knees and pelvic region.

3. The apparatus of claim 1 wherein said support frame is formed of a single piece of tubing so that rear locations of said rails are joined together.

4. The apparatus of claim 1 wherein each of said rails follows a compound curve having at least two different radii of curvature with a forward portion of each of said rails curving such as to follow a line hving a curvature which can be approximated by a circle having a shorter radius of curvature than that approximating a rearward portion in each of said rails.

5. The apparatus of claim 2 wherein said pair of legs extends away from said seat cushion base surface at locations near said seat cushion front facing end.

6. The apparatus of claim 4 wherein each of said rails has a portion at its extreme rear which follows a straight line.

7. The apparatus of claim 6 wherein each of said rails follows a compound curve having at least two different radii of curvature with a forward portion of each of said rails curving such as to follow a line having a curvature which can be approximated by a circle having a shorter radius of curvature than that approximating a rearward portion in each of said rails.

* * * * *